US007482741B2

(12) United States Patent
Hwang

(10) Patent No.: US 7,482,741 B2
(45) Date of Patent: Jan. 27, 2009

(54) FUNNEL FOR SLIM CATHODE RAY TUBES

(75) Inventor: Yong Ik Hwang, Kumi-si (KR)

(73) Assignee: LG. Philips Displays Korea Co., Ltd., Kumi-Si (KR)

( * ) Notice: Subject to any disclaimer, the term of this patent is extended or adjusted under 35 U.S.C. 154(b) by 381 days.

(21) Appl. No.: 11/346,165

(22) Filed: Feb. 3, 2006

(65) Prior Publication Data

US 2006/0255709 A1 Nov. 16, 2006

(30) Foreign Application Priority Data

May 10, 2005 (KR) ..... 10-2005-0038643

(51) Int. Cl.
*H01J 1/62* (2006.01)

(52) U.S. Cl. ..... 313/477 R; 313/634

(58) Field of Classification Search ..... 313/477 R, 313/480, 634

See application file for complete search history.

(56) References Cited

FOREIGN PATENT DOCUMENTS

KR 10-2004-0044067 A 5/2004

*Primary Examiner*—Vip Patel
(74) *Attorney, Agent, or Firm*—Birch, Stewart, Kolasch & Birch, LLP

(57) ABSTRACT

Disclosed herein is a funnel for slim cathode ray tubes. The funnel is constructed such that the deflection angle of an electron beam is 120 degrees or more. On the assumption that, at a top of round (TOR) part located between a body and a yoke part, the thickness of each long side (x-axis) is Tx, the thickness of each short side (y-axis) is Ty, and the thickness of each diagonal part is Td, the following inequality is satisfied: Td>Tx>Ty. The TOR part has a horizontal inner curvature, a horizontal outer curvature, and a vertical outer curvature, which are convex toward the outside of the funnel, and a vertical inner curvature, which is convex toward the inside of the funnel. On the assumption that, at the body from a seal edge, at which the body is joined with a panel, to the TOR part, the thickness of each long side (x-axis) is Bx, the thickness of each short side (y-axis) is By, and the thickness of each diagonal part is Bd, the thickness ratio of the body from the seal edge to the ⅔ point of the body is set such that the following inequality is satisfied: Bx>By>Bd.

14 Claims, 6 Drawing Sheets

FUNNEL FOR SLIM CATHODE RAY TUBES

BACKGROUND OF THE INVENTION

1. Field of the Invention

The present invention relates to a funnel for slim cathode ray tubes, and, more particularly, to a funnel for color cathode ray tubes constructed such that stress is prevented from being concentrated on the funnel when a deflection angle is 110 degrees or more.

2. Description of the Related Art

FIG. 1 is a side view, partially cut away, illustrating a conventional cathode ray tube. As shown in FIG. 1, the conventional cathode ray tube comprises a panel 1 and a funnel 2, which are joined with each other to constitute a tube part 10.

Inside the panel 1 is disposed a shadow mask 3, which is supported by a frame 4 such that the shadow mask 3 is approximately parallel with the panel 1. The frame 4 is fixed to the panel 1 via a spring 5. Inside the funnel 2 is disposed an inner shield 6 for shielding an external geomagnetic field to prevent the path of an electron beam from being curved by the external geomagnetic field.

In the rear part of the funnel 2 is fitted an electron gun 7 for generating an electron beam. At the outside of a neck part of the funnel 2 is mounted a deflection yoke 8 for deflecting an electron beam approximately 110 degrees or less.

In the conventional cathode ray tube with the above-stated construction, an electron beam emitted from the electron gun 7 is deflected above and below and right and left by the deflection yoke 8, and is then transmitted to the panel 1. Specifically, the deflected electron beam passes through-holes of the shadow mask 3, and is then transmitted to a fluorescent screen 9 coated on the inner surface of the panel 1. At this time, the fluorescent screen 9 is illuminated by the energy of the electron beam. Consequently, a picture is reproduced such that users can see the picture reproduced through the panel 1.

Meanwhile, the panel 1 and the funnel 2 are joined to each other by a frit sealing process, the electron gun 7 is fitted into the rear part of the funnel 2 by a subsequent encapsulation process, and a vacuum is formed in the tube part 10 by an extraction process. In this way, the cathode ray tube is manufactured.

When the tube part 10 is in the vacuum state, considerable tensile and compression stresses are applied to the panel 1 and the funnel 2.

FIG. 2 is a front view illustrating the funnel of the conventional cathode ray tube, and FIG. 3 is a side view illustrating the funnel of the conventional cathode ray tube. In the past, a yoke part 2*y* of the funnel 2 was formed in a circular structure. Recently, however, the yoke part 2*y* of the funnel 2 has been changed into a rectangular structure to increase deflection sensitivity of the deflection yoke. In the case of the rectangular-structure yoke part 2*y*, it is designed such that an angle of approximately 20 degrees or more is maintained at a top of round (TOR) part of the funnel 2 toward the panel 1.

In the conventional color cathode ray tube, the deflection angle of which is 110 degrees or less, the stress applied to a body 2*b* of the funnel 2 is less than that applied to the panel 1. Consequently, the stress applied to the body 2*b* of the funnel 2 does not have a great influence on an explosion-resistance test, which is an endurance test based on external impact.

However, the overall length of the tube part 10 is decreased with the development of a slim color cathode ray tube, and therefore, it is inevitable that the lengths of the panel 1 and the funnel 2 be decreased. As a result, the inner volume of the tube part 10 is also reduced. Consequently, stress applied to the panel 1 and the funnel 2 is increased.

Especially in the case of the funnel 2, it is structurally difficult to reduce the length of the yoke part 2*y*, at which the deflection yoke is mounted. For this reason, the length of the body 2*b* is generally reduced to decrease the overall length of the funnel 2. However, due to the reduction in length of the body 2*b* of the funnel 2, stress is concentrated at the TOR part, where the body 2*b* and the yoke part 2*y* are connected to each other. As a result, the explosion-resistance characteristic on the external impact is lowered.

Consequently, it is required that stress be prevented from being concentrated at the part where the body 2*b* and the yoke part 2*y* of the funnel 2 is connected although the length of the part at which the body 2*b* and the yoke part 2*y* of the funnel 2 is connected is reduced.

SUMMARY OF THE INVENTION

Therefore, the present invention has been made in view of the above problems, and it is an object of the present invention to provide a funnel for slim cathode ray tubes wherein the thickness of a body of the funnel and the thickness, the curvature, and the angle of a top of round (TOR) part of the funnel to prevent stress from being concentrated due to the reduction in overall length of a tube part, whereby the explosion-resistance characteristic of the funnel is improved.

In accordance with one aspect of the present invention, the above and other objects can be accomplished by the provision of a funnel for slim cathode ray tubes, wherein the funnel is constructed such that the deflection angle of an electron beam is 120 degrees or more, on the assumption that, at a top of round (TOR) part located between a body and a yoke part, the thickness of each long side (x-axis) is Tx, the thickness of each short side (y-axis) is Ty, and the thickness of each diagonal part is Td, the following inequality is satisfied: Td>Tx>Ty, the TOR part has a horizontal inner curvature, a horizontal outer curvature, and a vertical outer curvature, which are convex toward the outside of the funnel, and a vertical inner curvature, which is convex toward the inside of the funnel, and, on the assumption that, at the body from a seal edge, at which the body is joined with a panel, to the TOR part, the thickness of each long side (x-axis) is Bx, the thickness of each short side (y-axis) is By, and the thickness of each diagonal part is Bd, the thickness ratio of the body from the seal edge to the ⅔ point of the body is set such that the following inequality is satisfied: Bx>By>Bd.

Preferably, Tx/Ty is 1 to 1.3, Ty/Td is 0.6 to 1, and Tx/Td is 0.7 to 1.

Preferably, Tx is 5 mm to 12 mm, Ty is 4.5 mm to 10.8mm, and Td is 5.3 mm to 12.75 mm.

More preferably, Tx is 6.5 mm to 8.5 mm, Ty is 5.85 mm to 7.65 mm, and Td is 7 mm to 9 mm.

Preferably, the body has outer surface angles, which are set to from 0 degrees to 15 degrees over a predetermined distance from the TOR part toward the seal edge.

Preferably, the body is formed in the sectional shape of a convex lens at the ⅔ to ⅓ portion of the distance from the seal edge to the TOR part.

In accordance with another aspect of the present invention, there is provided a funnel for slim cathode ray tubes, wherein the funnel is constructed such that the deflection angle of an electron beam is 120 degrees or more, and the funnel has a top of round (TOR) part located between a body and a yoke part, the TOR part having a horizontal inner curvature, a horizontal outer curvature, and a vertical outer curvature, which are convex toward the outside of the funnel, and a vertical inner curvature, which is convex toward the inside of the funnel.

Preferably, the horizontal outer curvature of the TOR part is 500 to ∞, the vertical outer curvature of the TOR part is 375 to ∞, the horizontal inner curvature of the TOR part is 500 to ∞, and the vertical inner curvature of the TOR part is 1000 to ∞.

Preferably, the height difference of the horizontal outer surface at the TOR part, the height difference of the horizontal inner surface at the TOR part, the height difference of the vertical outer surface at the TOR part, and the height difference of the vertical inner surface at the TOR part are within 3 mm.

In accordance with yet another aspect of the present invention, there is provided a funnel for slim cathode ray tubes, wherein the funnel is constructed such that the deflection angle of an electron beam is 120 degrees or more, and, on the assumption that, at the body from a seal edge, at which the body is joined with a panel, to a top of round (TOR) part, which is separated from a yoke part, the thickness of each long side (x-axis) is Bx, the thickness of each short side (y-axis) is By, and the thickness of each diagonal part is Bd, the thickness ratio of the body from the seal edge to the ⅔ point of the body is set such that the following inequality is satisfied: Bx>By>Bd.

Preferably, the thickness ratio of the body from the ⅔ point of the body to the TOR part is set such that the following inequality is satisfied: Bd>Bx>By.

Preferably, the body has the maximum thickness at 0 to 20 mm from the seal edge, and the body has the minimum thickness at 30 to 70 mm from the seal edge.

Preferably, the ratio of the maximum thickness to the minimum thickness of the body is 1.3 to 3.

According to the present invention, the thickness of the body of the funnel for slim cathode ray tubes and the thickness, the curvature, and the angle of the TOR part of the funnel are appropriately designed to prevent stress from being concentrated due to the reduction in overall length of the tube part. Consequently, the present invention has the effect of improving the explosion-resistance characteristic of the funnel and producing a functional screen while satisfying BSN/YPB.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the accompanying drawings.

Figure 4:
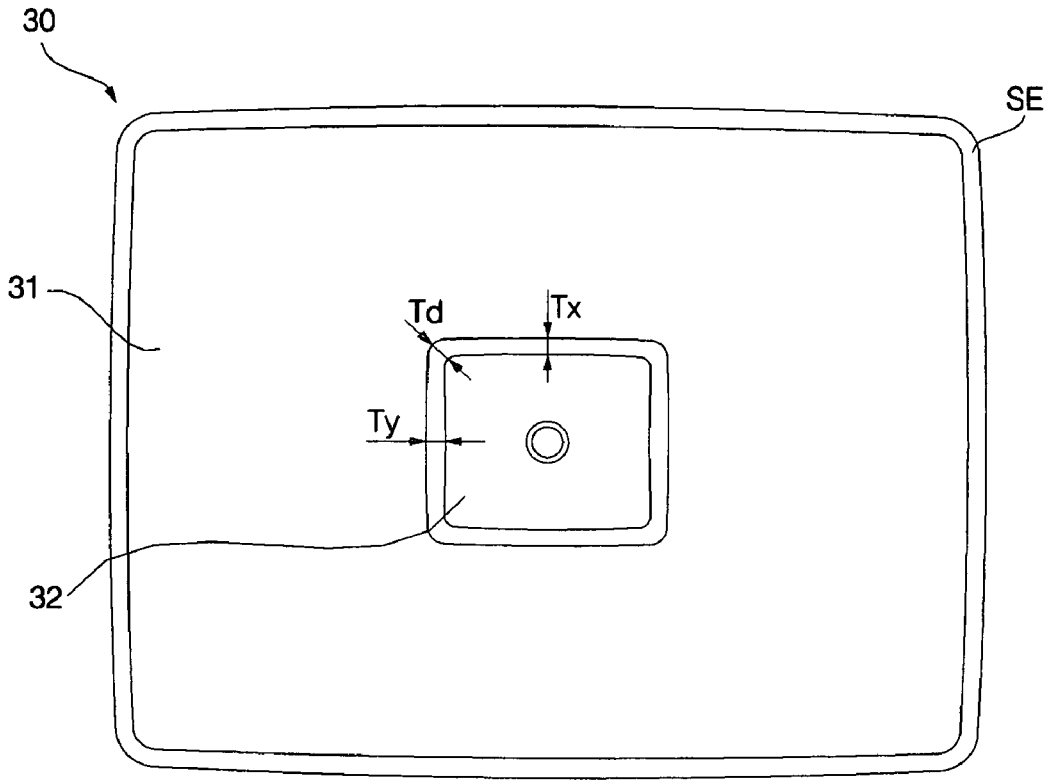
FIG. 4 is a front view illustrating a funnel for slim cathode ray tubes according to the present invention.
Figure 5:
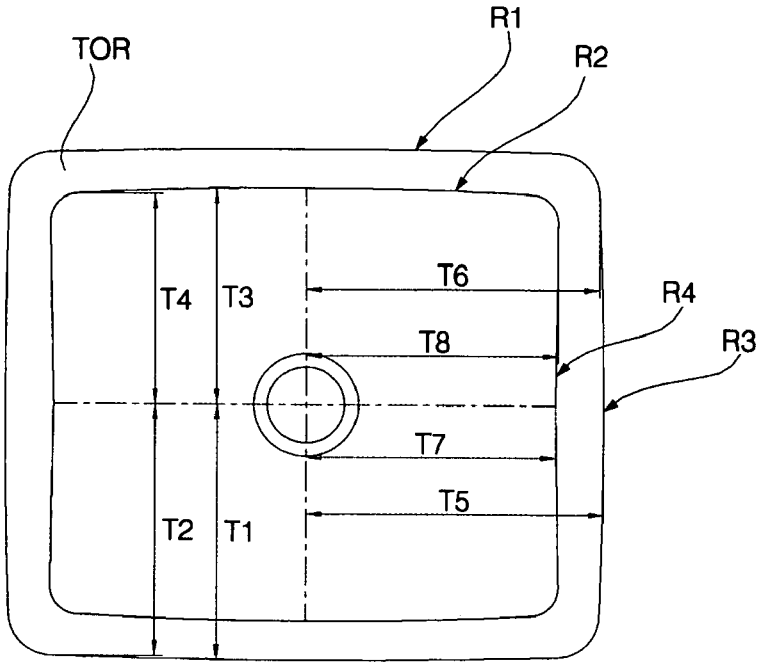
FIG. 5 is an enlarged view illustrating a top of round (TOR) part of the funnel shown in FIG. 4.
Figure 6:
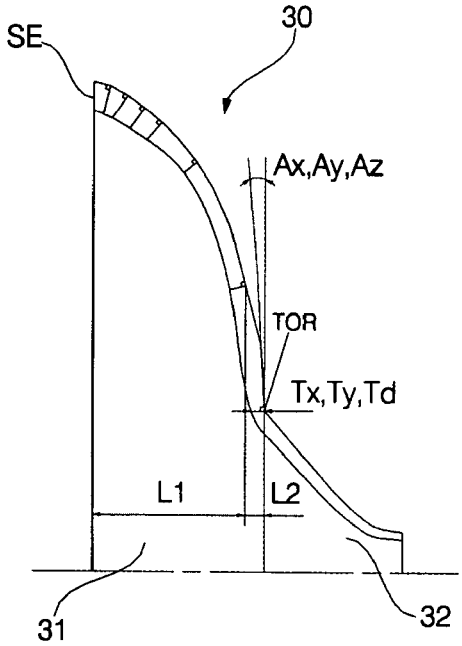
FIG. 6 is a side view illustrating the funnel for slim cathode ray tubes according to the present invention.

FIG. 4 is a front view illustrating a funnel 30 for slim cathode ray tubes according to the present invention, FIG. 5 is an enlarged view illustrating a top of round (TOR) part of the funnel 30 shown in FIG. 4, and FIG. 6 is a side view illustrating the funnel 30 for slim cathode ray tubes according to the present invention.

As shown in FIGS. 4 to 6, the funnel 30 according to the present invention is applied to a slim cathode ray tube wherein the deflection angle of an electron beam is 120 degrees or more and the overall length of the tube, which is formed by joining a panel (not shown) and the funnel 30 to each other, is considerably less than that of a conventional cathode ray tube.

The funnel 30 includes a body 31 and a yoke part 32, which are separated from each other about a top of round (TOR) part. The body 31 is a part extending from the TOR part to a seal edge SE, at which the body 31 is joined with the panel, and the yoke part 32 is a part extending from the TOR part to a neck sealing part.

Here, the yoke part 32 is a part where a deflection yoke is mounted. It is difficult to reduce the length of the yoke part 32, and therefore, the length of the body 31 is reduced. When the length of the body 31 is reduced, stress is concentrated on the body 31, and as a result, the body is easily damaged by external impact. Consequently, a design to prevent the concentration of the stress on the body 31 is required.

According to the present invention, the thickness, the curvature, and the angle of the TOR part, i.e., the part where the body 31 and the yoke part 32 are connected to each other, and the thickness of the body 31 are appropriately set to sufficiently deal with the concentration of stress due to the reduction in length of the body 31 of the funnel 30, and therefore, to prevent the concentration of stress.

First, on the assumption that the thickness of each long side (x-axis) at the TOR part of the body 31 is Tx, the thickness of each short side (y-axis) at the TOR part of the body 31 is Ty, and the thickness of each diagonal part at the TOR part of the body 31 is Td, the thickness at the TOR part of the body 31 is set such that the following inequality is satisfied: Td>Tx>Ty.

That is to say, the thickness Td of the diagonal part at the TOR part is the greatest, the thickness Tx of the long side at the TOR part is less than the thickness Td of the diagonal part at the TOR part and greater than the thickness Ty of the short side at the TOR part, and the thickness Ty of the short side at the TOR part is the least.

Referring now to FIG. 5, the short side (y-axis) at the TOR part of the body 31 has a vertical inner curvature R4, which is formed in the shape of an inverted round, i.e., convex toward the inside of the funnel 30. The long side (x-axis) at the TOR part of the body 31 has a horizontal outer curvature R1 and a horizontal inner curvature R2, both of which are convex toward the outside of the funnel 30 from the center of the funnel 30. Also, the short side (y-axis) at the TOR part of the body 31 has a vertical outer curvature R3, which is convex toward the outside of the funnel 30 from the center of the funnel 30.

Referring next to FIG. 6, the body 31 has outer surface angles Ax, Ay, and Ad, which are set to from 0 degrees to 15 degrees over a predetermined distance from the TOR part of the body 31 toward the seal edge SE.

TABLE 1

| | Outer surface angle (degrees) | | | | | |
|---|---|---|---|---|---|---|
| | 0 | 3 | 6 | 9 | 12 | 15 |
| Stress (Mpa) | 9 or more | 8.6 | 8.3 | 8 | 7.5 | 6 or less |

As indicated in Table 1, the stress ranges 6 to 9 Mpa depending upon the outer surface angles Ax, Ay, and Ad of the body 31, and therefore, the stress limit, 10 Mpa, is satisfied.

Also, the body 31 is formed such that the body 31 has the sectional shape of a convex lens at the ⅔ to ⅓ portion of the distance from the seal edge SE to the TOR part. Consequently, the concentration of stress at the body 31 is prevented.

Next, on the assumption that the thickness of each long side (x-axis) of the body 31 is Bx, the thickness of each short side (y-axis) of the body 31 is By, and the thickness of each diagonal part of the body 31 is Bd, the thickness ratio of the body 31 from the seal edge SE to the ⅔ point of the body 31 (L1) is set such that the following inequality is satisfied: Bx>By>Bd.

The dimensions of the funnel with the above-stated construction according to the present invention will be described in more detail.

First, the thickness at the TOR part of the body 31 is set to satisfy the following inequality: Td>Tx>Ty. At this time, the respective thicknesses Td, Tx, and Ty are set to a length in which a normal line drawn from a tangent line of the outer curvature of the TOR part crosses the inner curvature of the TOR part.

As described above, the funnel 30 is constructed such that at least one of the following conditions is satisfied: Tx/Ty is 1 to 1.3; Ty/Td is 0.6 to 1; and Tx/Td is 0.7 to 1.

Specifically, Tx is 5 mm to 12 mm, Ty is 4.5 mm to 10.8mm, and Td is 5.3 mm to 12.75 mm. Preferably, Tx is 6.5 mm to 8.5 mm, Ty is 5.85 mm to 7.65 mm, and Td is 7 mm to 9 mm.

If the ratios of Tx, Ty, and Td are not related to one another, a concentration of stress is induced in the slim cathode ray tube, the overall length of which is small. For this reason, it is required that Tx, Ty, and Td be set such that these thicknesses are appropriately related to one another.

That is to say, when the thickness of the TOR part is excessively large, a beam shadow neck (BSN) becomes small. When the thickness of the TOR part is small, on the other hand, the safety rule, i.e., the explosion-resistance characteristic is not satisfied.

When the deflection yoke is slowly moved backward from the position at which the deflection yoke is in tight contact with the tube, the deflected electron beam is caught at the inner surface of the yoke part 32, and therefore, the electron beam does not reach the fluorescent screen. Consequently, the fluorescent screen coated on the inner surface of the panel is not illuminated. The range of distances between the deflection yoke and the tube part where the fluorescent screen is not illuminated is indicated in mm. When the distance between the deflection yoke and the tube part is increased, the quality of the cathode ray tube may be improved.

The thicknesses Td, Tx, and Ty of the TOR part are important factors in designing the funnel 30. Consequently, the thicknesses Td, Tx, and Ty are set such that the thickness Td of the diagonal part at the TOR part is the greatest, the thickness Tx of the long side at the TOR part is less than the thickness Td of the diagonal part at the TOR part and greater than the thickness Ty of the short side at the TOR part, and the thickness Ty of the short side at the TOR part is the least. Also, the respective design values are set within the above-stated ranges with medians as optimized design values. When the design values are close to the optimum value section, the safety rule and BSN quality are both improved.

As shown in FIG. 5, the curvature of the TOR part of the body 31 is formed such that the horizontal outer curvature R1, the horizontal inner curvature R2, and the vertical outer curvature R3 are convex toward the outside of the funnel 30 while the vertical inner curvature R4 is convex toward the inside of the funnel 30. Furthermore, the radius of curvature of the TOR part is greater than that of the TOR part of the conventional cathode ray tube.

Specifically, the horizontal outer curvature R1 is 500 to ∞, the vertical outer curvature R3 is 375 to ∞, the horizontal inner curvature R2 is 500 to ∞, and the vertical inner curvature R4 is 1000 to ∞.

It is preferable that the height difference T1-T2 of the horizontal outer surface at the TOR sectional surface, the height difference T3-T4 of the horizontal inner surface at the TOR sectional surface, the height difference T5-T6 of the vertical outer surface at the TOR sectional surface, and the height difference T8-T7 of the vertical inner surface at the TOR sectional surface be all within 3 mm by the above-defined curvatures.

The reason why the curvatures are formed at the TOR part of the funnel 30 is that the deflection angle of the slim cathode ray tube is 120 degrees or more while the deflection angle of the conventional cathode ray tube is 90 degrees to 106 degrees, and therefore, the distance between the deflection center and the inner surface of the panel must be reduced 100 mm or more.

Due to the conditions described above, the conventional TOR sectional shape does not pass the safety rule, i.e., the explosion-resistance test. In addition, the conventional TOR sectional shape does not satisfy beam shadow neck (BSN)/yoke pull back (YPB).

Figure 1:
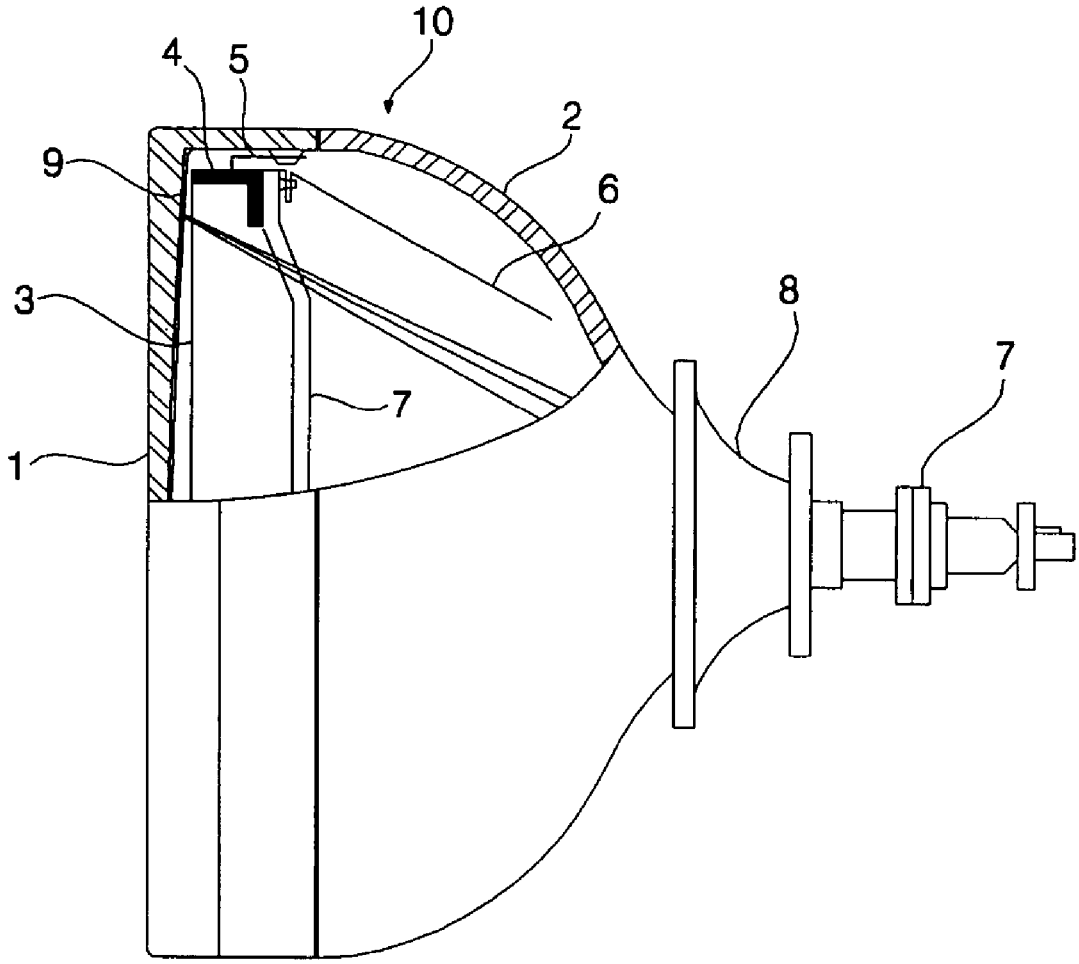
FIG. 1 (Prior Art)
FIG. 1 is a side view, partially cut away, illustrating a conventional cathode ray tube.
Figure 2:
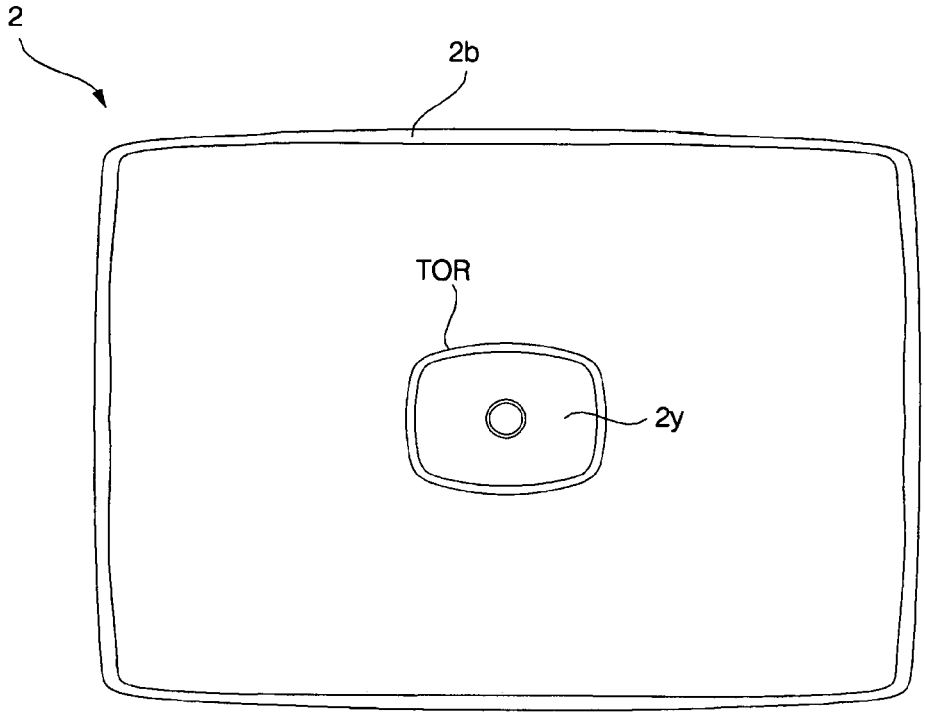
FIG. 2 (Prior Art)
FIG. 2 is a front view illustrating a conventional funnel for cathode ray tubes.
Figure 3:
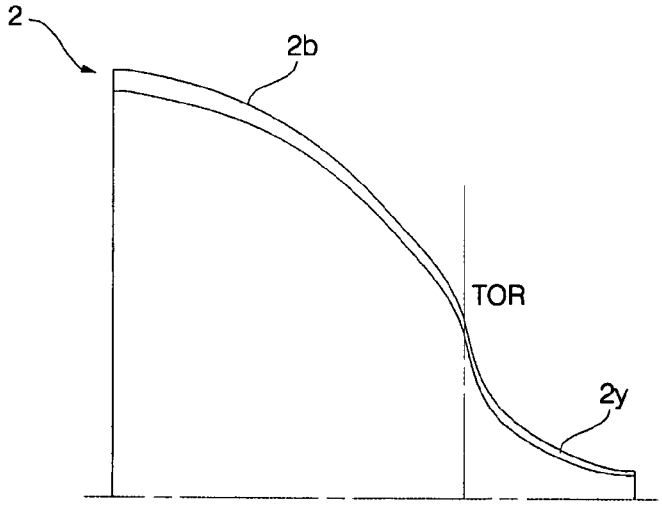
FIG. 3 (Prior Art)
FIG. 3 is a side view illustrating the conventional funnel for cathode ray tubes.

In the conventional cathode ray tube shown in FIG. 2, the TOR part is formed in the sectional shape of a barrel convex toward the outside of the funnel 30 at the vertical inner and outer surfaces and the horizontal inner and outer surfaces. Furthermore, the radius of curvature of the conventional cathode ray tube is less than that of the slim cathode ray tube according to the present invention.

On the contrary, the funnel 30 according to the present invention is designed such that the radius of curvature of the TOR part at the inner and outer surfaces is greater than those of the TOR part of the conventional cathode ray tube and the vertical inner curvature R4 is convex toward the inside of the funnel 30. Consequently, the explosion-resistance characteristic and BSN/YPB, which is a structural quality, are improved through the uniform distribution of stress at the long and short sides.

Since the vertical inner curvature R4 is convex toward the inside of the funnel 30, the interference in reflection of the electron beam is prevented, and the stress is reduced. Specifically, when the vertical inner curvature R4 is convex toward the inside of the funnel 30, the inner corner of the TOR part extends outward as compared to the conventional cathode ray tube, and therefore, the optical deflection is satisfied. Furthermore, the length of the major axis is greater than that of the minor axis, and therefore, the thickness of the vertical inner curvature of the TOR part is convex toward the inside of the funnel 30. Consequently, the stress applied to the TOR part is reduced.

In the above description, the yoke pull back (YPB) indicates the distance between the position at which the deflection yoke is in tight contact with the tube part of the cathode ray tube and the deflection yoke in the state in which a product cleaning process is completed.

As shown in FIG. 6, the body 31 is formed such that the outer surface angles Ax, Ay, and Ad of the body 31 are 0 degrees to 15 degrees from the TOR part of the body 31 toward the seal edge SE. At this time, the body 31 has the sectional shape of a convex lens between the TOR part and a distance of 30 mm from the TOR part toward the seal edge SE.

The construction of the funnel for slim cathode ray tubes according to the present invention will be described hereinafter based on the experiment results indicated in Table 2.

Next, the body 31 is formed such that the thickness ratio of the body 31 from the seal edge SE to the ⅔ point of the body 31 (L1) is set such that the following inequality is satisfied: Bx>By>Bd.

Here, the thickness of the body 31 is set to a length in which a normal line of the outer curvature crosses the inner curvature, as shown in FIG. 6.

The reason why the thickness of the body 31 of the funnel 30 is set as described above is that stress is concentrated at the outside of each diagonal part of the yoke part 32 due to the reduction of the overall length of the cathode ray tube, which was confirmed by experiments. The reduction of stress at the outside of each diagonal part of the yoke part 21 is important in designing the funnel 30 for slim cathode ray tubes.

When the thickness distribution of the body 31 of the funnel 30 is designed such that the ratio of Bx, By, and Bd is equally applied according to the aspect ratio of 4:3 or 16:9while the values have different ranges as described above, low stress is uniformly distributed at the outer surface of the funnel 30 while the tube is in a vacuum state.

The funnel 30, which is applied to the slim cathode ray tube, is constructed such that the diagonal line is the longest, the long side is smaller that the diagonal line and longer that the short side, and the short side is the shortest. However, the diagonal part is a position where the long side crosses the short side, and therefore, the diagonal part has a relatively high rigidity. Consequently, although the diagonal part is designed such that the thickness of the diagonal part is less than those of the long and short sides, the stress limit is satisfied. Furthermore, the manufacturing costs are reduced and the weight of the cathode ray tube is decreased because the diagonal part is formed with a small thickness.

Also, when the thickness Bd of the diagonal part is unnecessarily increased, stress is relatively concentrated on the yoke part 32. Consequently, the thickness Bd of the diagonal part of the body 31 is reduced such that the thickness of the diagonal part of the body 31 has a ratio less than the thickness Bx of the long side and the thickness By of the short side, whereby the stress of the body 31 is increased within the allowable range, and therefore, the stress at the yoke part 32 is lowered.

Preferably, the maximum thickness of the body 31 is present at the 0 to ⅓ portion of the length from the seal edge SE to the TOR part (for example, within 20 mm from the seal edge), and the minimum thickness of the body 31 is present at the ⅓ to ⅔ portion of the length from the seal edge SE to the TOR part (for example, 30 to 70 mm from the seal edge). Also preferably, the ratio of the maximum thickness to the minimum thickness of the body 31 is 1.3 to 3.

In the analysis and experiments of the funnel 30 applied to the slim cathode ray tube, the degree of the stress concentration on the outer surface of the panel is the highest at the long side (x-axis) and is the lowest at the diagonal part (d-axis). The degree of the stress concentration on the outer surface of the panel at the short side (y-axis) is lower than the degree of the stress concentration on the outer surface of the panel at the long side (x-axis) and higher than the degree of the stress concentration on the outer surface of the panel at the diagonal part (d-axis). Consequently, the degree of the stress concentration is changed depending upon the size of the cathode ray tube, and therefore, the thickness of the seal edge SE forming the maximum thickness of the funnel 30 is changed, whereby the thickness of the body 31 of the funnel 230 is decided.

Preferably, the thickness ratio of the body 31 from the ⅔ point of the body 31 to the TOR part (L2) is set such that the following inequality is satisfied: Bd>Bx>By.

Now, the funnel 30 with the above-stated construction according to the present invention will be described with reference to FIGS. 7 to 10 and the experiment results indicated in Table 2 below.

TABLE 2

| | | Experiment 1 | | Experiment 2 | | Experiment 3 | | Experiment 4 | |
|---|---|---|---|---|---|---|---|---|---|
| Stress limit (Mpa) | | Minor axis | Major axis | Minor axis | Major axis | Minor axis | Major axis | Minor axis | Major axis |
| Face part | 11.5 | 6.7 | 7.8 | 6.5 | 7.3 | 6.6 | 7.6 | 5.6 | 7.6 |
| Sidewall | | 12.1 | 10.1 | 11.4 | 9.4 | 11.3 | 9.2 | 11.3 | 9.2 |
| Skirt part | | 12.9 | 13.1 | 11.4 | 12.6 | 9.8 | 9.0 | 9.8 | 9.0 |
| Seal edge | 10.0 | 9.4 | 10.5 | 11.1 | 12.6 | 9.6 | 8.9 | 9.7 | 8.9 |
| Body | 11.5 | 12.1 | 6.0 | 12.1 | 12.3 | 10.0 | 7.2 | 10.1 | 7.3 |
| Yoke part | 10.0 | 8.8 | | 7.8 | | 9.4 | | 8.6 | |

For reference, Experiment 3 and Experiment 4 were performed on condition that the thickness of the short side from the ⅔ point of the body 31 to the TOR part was equal to those of the long side from the ⅔ point of the body 31 to the TOR part (for example, the thickness of the short side was 12.2mm, and the of the long side was 12.2 mm), and the thickness of the diagonal part was different from those of the short and long sides (for example, the thickness of the diagonal part was 14.0 mm for Experiment 3 while the thickness of the diagonal part was 14.5 mm for Experiment 4).

For Experiment 1, the TOR angle of the funnel 30 was 15 degrees or more, and the ratio in thickness of the whole body 31 was set, such that the following inequality was satisfied: Bx>By>Bd, to distribute the stress of the panel.

Figure 7:
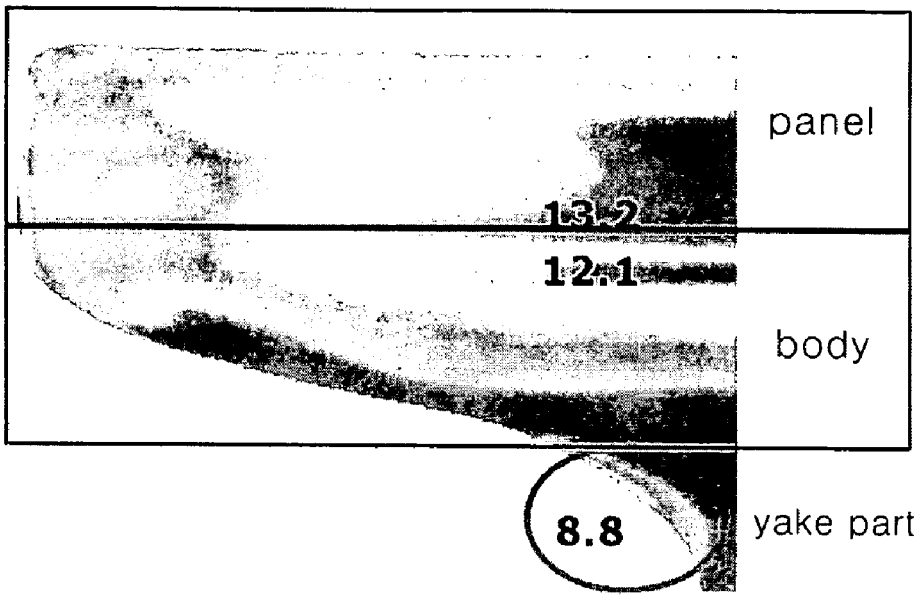
FIGS. 7 to 10 are views illustrating stress distribution of a slim cathode ray tube based upon the change of conditions.

Referring to Table 2 and FIG. 7, the stress of the yoke part 32 was 8.8 Mpa when the TOR angle of the funnel 30 was 15 degrees or more, and therefore, the stress limit, 10.0 Mpa, was satisfied. However, the stress at the outer surface of the skirt part of the panel was 13.2 Mpa, which exceed the stress limit, 11.5 Mpa.

For Experiment 2, the TOR angle of the funnel 30 was 15 degrees or more, and the ratio in thickness of the whole body 31 was set, such that the following inequality was satisfied: Bx>By>Bd, and the body 31 was optimally designed to uniformly distribute the stress of the panel.

Figure 8:
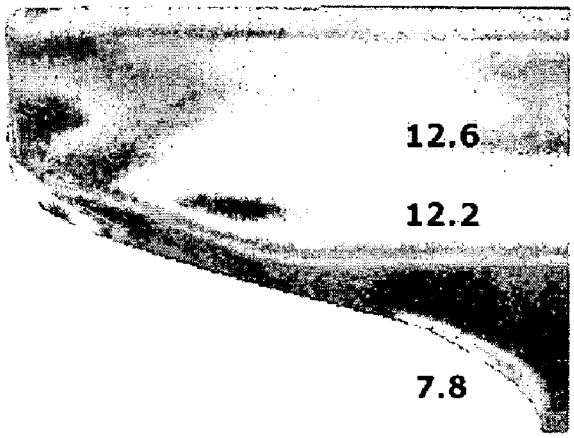

Referring to Table 2 and FIG. 8, the stress of the yoke part 32 was 7.8 Mpa when the TOR angle of the funnel 30 was 15 degrees or more, and therefore, the stress limit, 10.0 Mpa, was satisfied. However, the stress at the outer surface of the skirt part of the panel was 12.6 Mpa, which exceed the stress limit, 11.5 Mpa.

Consequently, it was required to reduce the TOR angle of the funnel 30 such that the stress concentrated on the panel is distributed, and therefore, the stress of the panel is effectively reduced.

Figure 9:
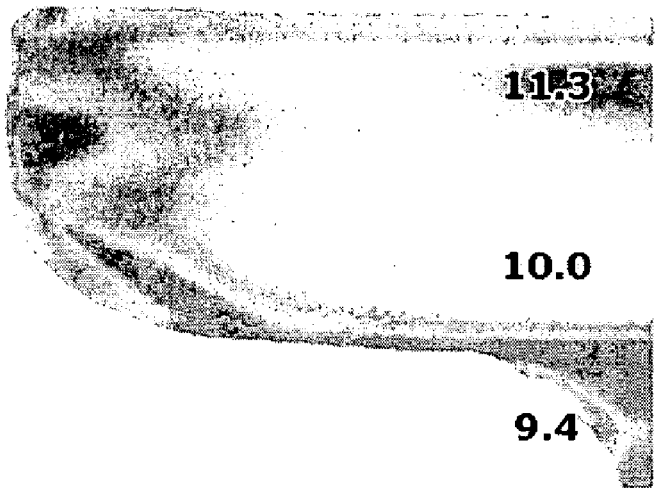

For Experiment 3, as shown in Table 2 and FIG. 9, the TOR angle of the funnel 30 was set to 15 degrees or less, to increase the volume of the body 31 of the funnel 30, and the ratio in thickness of the body 31 from the seal edge SE to the ⅔ portion of the body 31 was set, such that the following inequality was satisfied: Bx>By>Bd, and the ratio in thickness of the body 31 from the ⅔ portion of the body 31 to the TOR part was set, such that the following inequality was satisfied: Bd>Bx>By, in a manner different from Experiment 1 and Experiment 2, to distribute the stress of the yoke part 32.

In this case, the face part, the sidewall, and the skirt part of the panel satisfied the stress limit in the minor axis and in the major axis, and the stress of the yoke part 32 was 9.4 Mpa as a result of the decrease of the angle of the TOR part.

The stress of the body 31 did not exceed the stress limit, 11.5 Mpa, and the stress of the yoke part 32 did not exceed the stress limit, 10.0 Mpa, as a result of appropriate setting of the thicknesses Bx, By, and Bd of the body 31 of the funnel 30. Consequently, the stress limit was satisfied over the whole region constituting the panel and the funnel 30.

Figure 10:
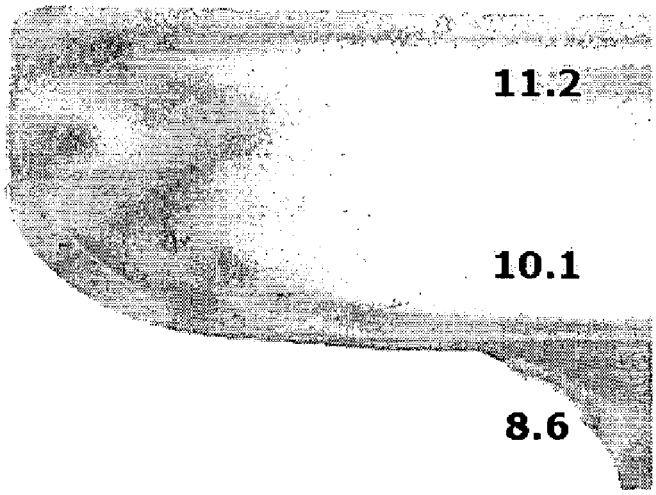

For Experiment 4, as shown in Table 2 and FIG. 10, the TOR angle of the funnel 30 was set to 15 degrees or less, to increase the volume of the body 31 of the funnel 30, and the ratio in thickness of the body 31 from the seal edge SE to the ⅔ portion of the body 31 was set, such that the following inequality was satisfied: Bx>By>Bd, and the ratio in thickness of the body 31 from the ⅔ portion of the body 31 to the TOR part was set, such that the following inequality was satisfied: Bd>Bx>By, in the same manner as the Experiment 3, and the thickness of the diagonal part was increased as compared to Experiment 3, to distribute the stress of the yoke part 32.

In this case, the respective parts of the panel, i.e., the face part, the sidewall, and the skirt part of the panel satisfied the stress limit in the minor axis and in the major axis. In addition, the body and the yoke part of the funnel satisfied the stress limit in the minor axis and in the major axis.

Especially, the thickness of the diagonal part of the body of the funnel was increased as compared with Experiment 3, and therefore, the stress of the yoke part was considerably lowered to 8.6 Mpa. Consequently, the stress concentrated on the yoke part was appropriately distributed.

It should be noted that, when the thickness of the body 31 of the funnel 30 is increased, the manufacturing costs are increased, and the effect of the deflection yoke, which is a principal characteristic of the screen, is lowered. Consequently, the dimensions of the respective parts of the funnel are appropriately set to optimize the thicknesses and relevant ratios.

As apparent from the above description, the thickness of the body of the funnel for slim cathode ray tubes and the thickness, the curvature, and the angle of the TOR part of the funnel are appropriately designed to prevent stress from being concentrated due to the reduction in the overall length of the tube part. Consequently, the present invention has the effect of improving the explosion-resistance characteristic of the funnel and producing a functional screen while satisfying BSN/YPB.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A funnel for slim cathode ray tubes, wherein the funnel is constructed such that the deflection angle of an electron beam is 120 degrees or more, on the assumption that, at a top of round (TOR) part located between a body and a yoke part, the thickness of each long side (x-axis) is Tx, the thickness of each short side (y-axis) is Ty, and the thickness of each diagonal part is Td, the following inequality is satisfied: Td>Tx>Ty, the TOR part has a horizontal inner curvature, a horizontal outer curvature, and a vertical outer curvature, which are convex toward the outside of the funnel, and a vertical inner curvature, which is convex toward the inside of the funnel, and on the assumption that, at the body from a seal edge, at which the body is joined with a panel, to the TOR part, the thickness of each long side (x-axis) is Bx, the thickness of each short side (y-axis) is By, and the thickness of each diagonal part is Bd, the thickness ratio of the body from the seal edge to the ⅔ point of the body is set such that the following inequality is satisfied: Bx>By>Bd.

2. The funnel as set forth in claim 1, wherein Tx/Ty is 1 to 1.3.

3. The funnel as set forth in claim 1, wherein Ty/Td is 0.6 to 1.

4. The funnel as set forth in claim 1, wherein Tx/Td is 0.7 to 1.

5. The funnel as set forth in claim 1, wherein Tx/Ty is 1 to 1.3, Ty/Td is 0.6 to 1, and Tx/Td is 0.7 to 1.

6. The funnel as set forth in claim 1, wherein Tx is 5 mm to 12 mm, Ty is 4.5 mm to 10.8 mm, and Td is 5.3 mm to 12.75 mm.

7. The funnel as set forth in claim 6, wherein Tx is 6.5 mm to 8.5 mm, Ty is 5.85 mm to 7.65 mm, and Td is 7 mm to 9 mm.

8. The funnel as set forth in claim 1, wherein the body has outer surface angles, which are set to from 0 degrees to 15 degrees over a predetermined distance from the TOR part toward the seal edge.

9. The funnel as set forth in claim 8, wherein the body is formed in the sectional shape of a convex lens at the ⅔ to ⅓ portion of the distance from the seal edge to the TOR part.

10. A funnel for slim cathode ray tubes, wherein the funnel is constructed such that the deflection angle of an electron beam is 120 degrees or more, and on the assumption that, at the body from a seal edge, at which the body is joined with a panel, to a top of round (TOR) part, which is separated from a yoke part, the thickness of each long side (x-axis) is Bx, the thickness of each short side (y-axis) is By, and the thickness of each diagonal part is Bd, the thickness ratio of the body from the seal edge to the ⅔ point of the body is set such that the following inequality is satisfied: Bx>By>Bd.

11. The funnel as set forth in claim 10, wherein the thickness ratio of the body from the ⅔ point of the body to the TOR part is set such that the following inequality is satisfied: Bd>Bx>By.

12. The funnel as set forth in claim 10, wherein the body has the maximum thickness at 0 to 20 mm from the seal edge.

13. The funnel as set forth in claim 12, wherein the body has the minimum thickness at 30 to 70 mm from the seal edge.

14. The funnel as set forth in claim 13, wherein the ratio of the maximum thickness to the minimum thickness of the body is 1.3 to 3.

* * * * *